United States Patent [19]

Kitsos et al.

[11] Patent Number: 5,014,874

[45] Date of Patent: May 14, 1991

[54] REFUSE CONTAINER

[75] Inventors: George G. Kitsos, 1220 E. Hawthorne Cir., Hollywood, Fla. 33021; Christos G. Kitsos, Filiatra, Greece

[73] Assignee: George G. Kitsos, Hollywood, Fla.

[21] Appl. No.: 414,327

[22] Filed: Sep. 29, 1989

[51] Int. Cl.[5] ..... B65D 83/10

[52] U.S. Cl. ..... 220/908; 206/366; 220/345; 220/350

[58] Field of Search ..... 220/1 T, 345, 346, 350; 206/370, 303, 366, 438

[56] References Cited

U.S. PATENT DOCUMENTS

| | | | |
|---|---|---|---|
| 1,102,275 | 7/1914 | Kime | 220/1 T |
| 1,226,634 | 5/1917 | Briese | 220/1 T |
| 1,238,010 | 1/1917 | Fisher | 220/1 T |
| 1,238,090 | 8/1917 | Beringer | 220/1 T |
| 1,251,870 | 1/1918 | Denzer | 220/1 T |
| 1,286,368 | 12/1918 | Lucas . | |
| 1,554,660 | 9/1925 | Ruskay . | |
| 2,527,461 | 10/1950 | Snadden . | |
| 2,757,859 | 8/1956 | Holland . | |
| 3,084,789 | 4/1962 | Kirby . | |
| 3,720,346 | 3/1973 | Cypher | 220/1 T |
| 4,842,138 | 6/1989 | Sandel et al. | 220/1 T |
| 6,976,655 | 4/1902 | O'Leary . | |

*Primary Examiner*—Joseph Man-Fu Moy

*Attorney, Agent, or Firm*—Harness, Dickey & Pierce

[57] ABSTRACT

A refuse container is disclosed which effectively shields the contained refuse from the surrounding area including to persons placing additional refuse therein.

17 Claims, 2 Drawing Sheets

REFUSE CONTAINER

BACKGROUND OF THE INVENTION

Refuse containers are used in a wide variety of settings such as in restaurants, theaters, and individual residences. These containers provide for the storage of refuse until such a time as the refuse contained therein may be further disposed of. Two principal difficulties have been experienced with prior refuse containers; i.e.. the refuse contained in these refuse containers has been known to be both unsightly and capable of generating foul odors. Many of these past refuse containers have failed to effectively seal off the contained refuse from the surrounding area, thus allowing the area to be polluted by these odors. Secondly, these past refuse containers, even though they may effectively seal the refuse from the surrounding area, have failed to effectively mask the sight of the refuse from users of the container. That is, if one wished to deposit refuse within these containers, one was exposed to the unsightliness of the refuse already within the container. This unsightliness might result in a diminution in the use of such a container.

SUMMARY OF THE INVENTION

According to the teachings of the present invention, the refuse container both effectively seals refuse contained therein from the surrounding area and masks the sight of such refuse from those using the container.

To achieve these objectives, the refuse container made in accordance with the teachings of this invention contains a body; a generally horizontal refuse receiving member positioned within the body; and a second member which slides within and across the body. The slidable member contains a loading opening and two generally vertical members which are made to slide generally over the horizontally positioned refuse receiving member.

In the closed position, the refuse container completely encapsulates the refuse contained therein, thereby effectively sealing the refuse from the surrounding area. Foul odors associated with the refuse are therefore substantially blocked. In the open position, the slidable member is made to move across the refuse container body such that its opening is positioned generally above the refuse receiving member. In this position, direct visual communication is not possible between the opening and the refuse contained within the container. The sight of the refuse is therefore blocked. This arrangement further substantially blocks the emanation of foul odors from the contained refuse to the surrounding area. New refuse is placed upon the refuse receiving member through the opening in the slidable member. Upon completion of the refuse deposit, the container is then placed in its closed position. This is accomplished by moving the slidable member across the body of the container such that one of its vertical members traverses the horizontally positioned refuse receiving member to move refuse into the refuse container body. This vertical member can also contain a plurality of bristles which act to further clean the horizontal member and move residual refuse into the container. In the closed position, the opening in the slidable member is covered by the top of the container body. Thus, additional refuse may not be placed within the container until it is placed in the open position.

BRIEF DESCRIPTION OF THE DRAWINGS

The various advantages of the present invention will become apparent to those skilled in the art by reading the following specification and by reference to the drawings in which.

DESCRIPTION OF THE PREFERRED EMBODIMENT

Figure 1:
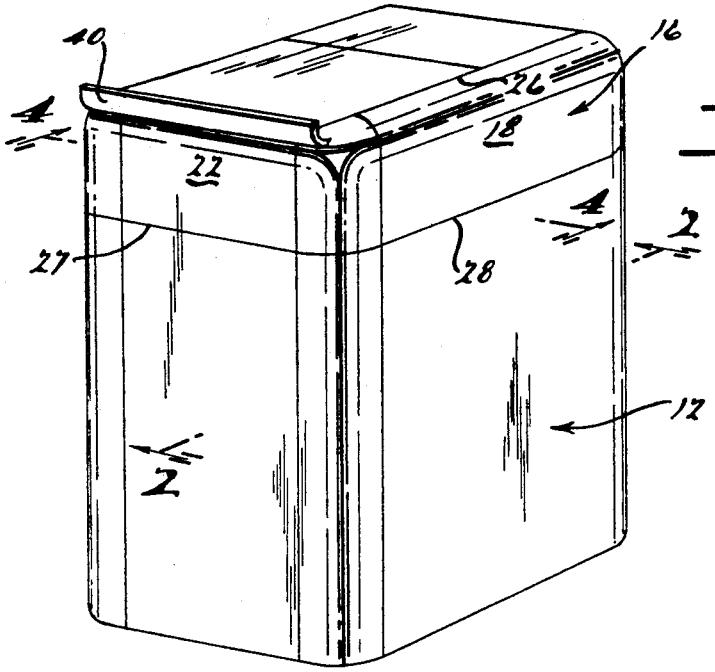
FIG. 1 is a perspective view of a refuse container embodying the teachings of this invention.

The refuse container made in accordance with the teachings of the preferred embodiment of this invention has a rectangularly shaped and hollow lower body portion 12 in the general form of an open-top box having an indented flange 14 around the upper edge thereof, and a rectangularly shaped and slightly rounded hollow upper body portion 16 having sidewalls 18 and 20, a front wall 22, a back wall 24, a top 23 having a refuse loading opening 25 extending from the front of the container, and a bottom peripheral edge 27 which closely mates with flange 14 to attach body portions 12 and 16 together in a removable slip fit.

Portion 16 further has a horizontal shelf 26 connected to walls 18, 20 and 22 and extending approximately one-half the distance to the back of the container. Shelf 26 acts as a horizontal refuse receiving member. Portion 16 has double side-wall portions defining inner walls 28 and 30 and a pair of support slots 32 and 34, as best seen in FIG. 4.

Figure 2:
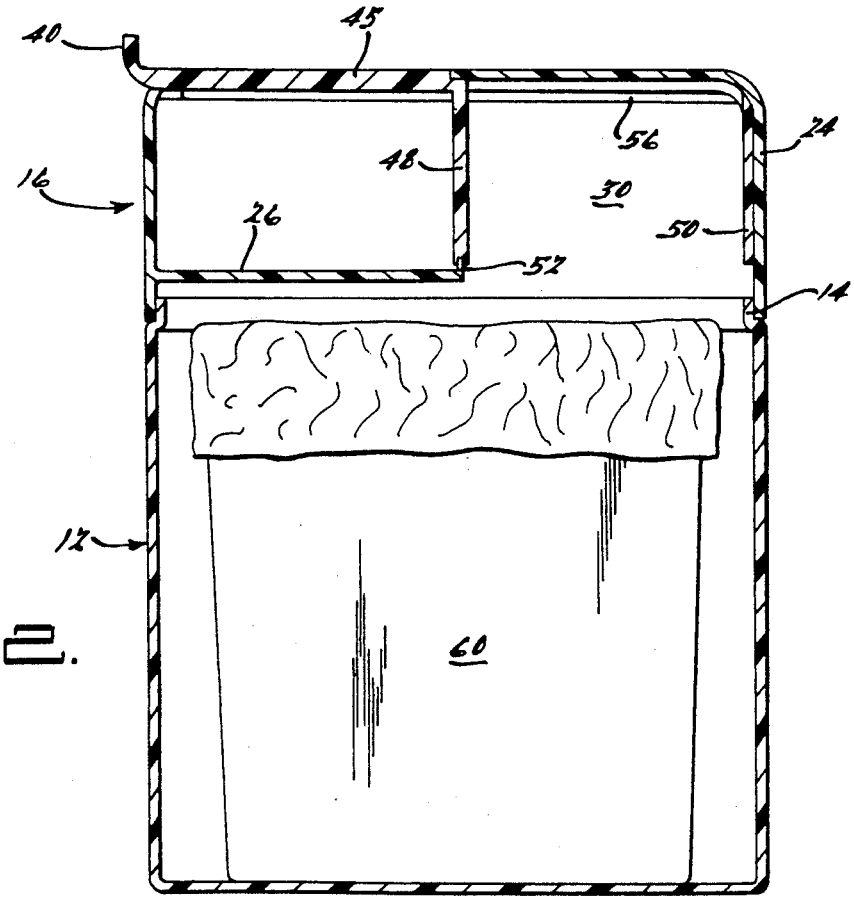
FIG. 2 is a vertical sectional view taken generally along line 2—2 in FIG. 1.
Figure 4:
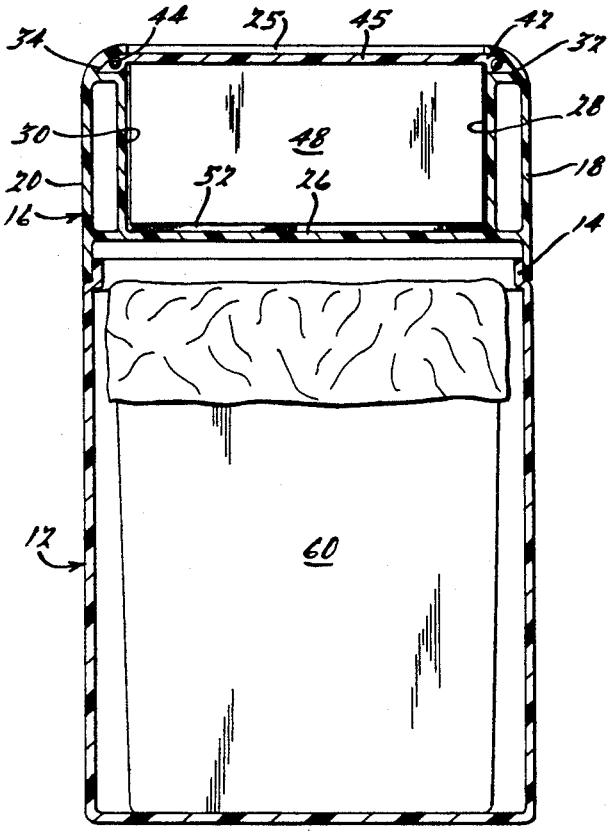
FIG. 4 is a vertical sectional view taken generally along line 4—4 in FIG. 1.
Figure 5:
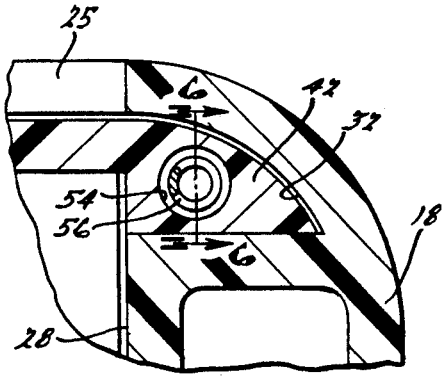
FIG. 5 is an enlarged fragmentary view of the upper right hand corner of FIG. 4.
Figure 6:
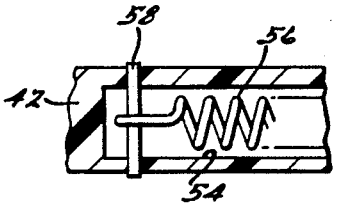
FIG. 6 is a sectional view taken generally along line 6—6 in FIG. 5.
Figure 3:
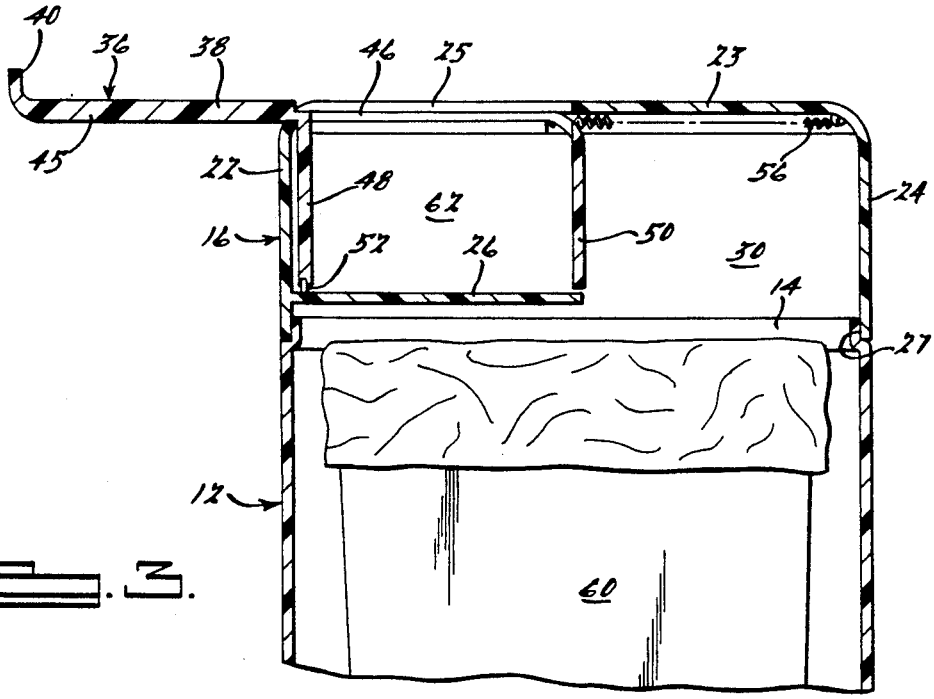
FIG. 3 is a view similar to FIG. 2 showing the upper portion of the container in an open refuse-loading position.

As best shown in FIGS. 2, 3 and 4, the container further comprises a slidable member 36 operatively disposed within body portion 16 and having a generally horizontal body 38 having a raised handle 40 at the front end thereof and side flanges 42 and 44 which are slidably guided and supported in support slots 32 and 34, respectively, so as to allow member 36 to slide within and across body 16 between its open positions (FIG. 3) and its closed portion (FIG. 2).

Member 36 has an inperforate portion 45 which effectively closes opening 25 when member 36 is in its closed position, an opening 46 which registers with opening 25 in the open position of member 36, and vertical partition members 48 and 50 depending therefrom adjacent the front and back edges of opening 46.

A brush 52 comprising a plurality of bristles is affixed to the bottom edge of member 48 for sweeping shelf 26. Additionally, as best shown in FIGS. 3–6, each flange 42 and 44 has an elongated blind hole 54 in which is disposed a tension spring 56 affixed at front end to the blind end of hole 54 by a suitable transverse press fit pin 58 or the like, and at its rear end to wall 24 in any desired manner. Springs 56 operate to bias member 36 to its closed position as shown in FIG. 2.

In operation, upper body portion 16 is lifted off lower body portion 12 and a trash receptacle 60 is placed within the refuse storage chamber defined by body portion 12. Portions 12 and 16 are then reattached with member 36 in its closed position, as shown in FIG. 2. In this closed position, body portions 16 and 12 cooperate with portion 45 of member 36 so as to encapsulate trash receptacle 60, thus preventing the emanation of foul smells or odors therefrom and preventing visual communication therewith from the surrounding area of the container. In this closed position, springs 56 serve to prevent the accidental opening of the container.

When it is desired to place refuse within the container, handle 40 is pulled to cause member 36 to move to its open position as shown in FIG. 3 until member 48 engages wall 22. In this open position, opening 46 is aligned with opening 25 and is positioned directly above shelf 26 so that refuse may be placed thereon. In this open position, walls 28 and 30 cooperate with members 48 and 50 and shelf 26 to define a temporary refuse reception chamber 62 which is substantially sealed from trash receptacle 60. Thus, the sight and smell associated with refuse container therein is masked to the person placing refuse within the container.

After refuse has been placed on shelf 26, handle 40 is released and springs 56 automatically cause member 36 to be returned to its closed position. Thus, springs 56 act to prevent refuse on shelf 26 to be left in a state of active communication with the surrounding area. The return of member 36 to a closed position causes member 48 to move across shelf 26 causing the refuse thereon to be moved into trash receptacle 60. This movement further causes bristles 52 to sweep across the upper surface of shelf 26 thereby cleaning same.

While this invention has been described in connection with a particular example, no limitation is intended except as defined by the following claims. The skilled practitioner will realize that other modifications may be made without departing from the spirit of this invention after studying the specification and drawings.

We claim:

1. A refuse container comprising:

(a) body means defining an enclosure for storing refuse;

(b) a loading opening in said body means communicating with the interior thereof;

(c) slidable means, disposed within said body means for closing said opening when in a closed position and for defining a temporary refuse receiving chamber in communication with said opening when in an open position, said slidable means generally sealing said opening and chamber from the remaining interior of said body means when in an open position; and (d) partition means on said slidable means for moving refuse in said chamber to the interior of said body means when said slidable means is moved from said open position to said closed position.

2. The refuse container as claimed in claim 1 wherein said body means is generally rectangular in horizontal section and in both vertical sections.

3. The refuse container as claimed in claim 1 wherein said partition means comprises a brush for sweeping refuse off the bottom of said chamber when said slidable means moves from said open position to said closed position.

4. The refuse container as claimed in claim 1 further comprising spring means biasing said slidable member to its closed position.

5. The refuse container as claimed in claim 1 further comprising access means for permitting access to the interior of said body means to remove refuse therefrom.

6. The refuse container as claimed in claim 1 wherein said body means comprises separable upper and lower body portions, said slidable means being disposed in said upper body portion with refuse being disposed in said lower body portion.

7. The refuse container as claimed in claim 1 wherein said loading opening is disposed in the top of said refuse container, and further comprising a generally horizontal shelf disposed below said loading opening for temporarily receiving refuse deposited through said opening.

8. The refuse container as claimed in claim 7 wherein said opening and shelf are disposed adjacent the front of said refuse container.

9. The refuse container as claimed in claim 8 wherein said slidable means is mounted for movement in a front to back direction and has two generally vertical transversely disposed partitions extending from adjacent the top of said refuse container to the level of said shelf, one of said partitions generally sealing said loading opening from the lower interior of said body means when in said open position and the other of said partitions being operable to sweep refuse on said shelf into the lower interior of said body means when moved from said open position to said closed position.

10. The refuse container as claimed in claim 9 further comprising a brush on the lower edge of said other partition.

11. The refuse container as claimed in claim 9 wherein said slidable means comprises a generally horizontal member with an opening therein which aligns with said loading opening when in said open position.

12. The refuse container as claimed in claim 11 wherein said partitions depend from said horizontal member.

13. The refuse container as claimed in claim 9 wherein said body means has a pair of support slots therein sand said slidable means has a pair of flanges supportingly and slidably disposed in said slots.

14. The refuse container as claimed in claim 9 further comprising spring means for biasing said slidable means to said closed position.

15. The refuse container as claimed in claim 14 further comprising means defining a pair of elongated holes in said slidable means and a tension spring disposed in each of said holes with one end affixed to said slidable means and the other end affixed to said body means.

16. The refuse container as claimed in claim 2 wherein said body means has rounded corners.

17. The refuse container as claimed in claim 16 wherein the depth of said body means is greater than the width thereof and wherein said slidable means has a handle extending along the front top edge of said refuse container.

* * * * *

UNITED STATES PATENT AND TRADEMARK OFFICE

CERTIFICATE OF CORRECTION

PATENT NO. : 5,014,874

DATED : May 14, 1991

INVENTOR(S) : George G. Kitsos et al

It is certified that error appears in the above-identified patent and that said Letters Patent is hereby corrected as shown below:

On the title page: Item [56] Reference Cited:

reference to "Fisher", "1/1917" should be -- 8/1917 --.

reference to "O'Leary", "6,976,655" should be -- 697,655 --.

Column 1, lin 10, "i.e.." should be -- i.e., --.

Column 2, line 17, "4.," should be -- 4; --.

Column 2, line 51, "inperforate" should be -- imperforate --.

Column 4, line 45, "sand" should be -- and --.

Signed and Sealed this

Fourteenth Day of September, 1993

Bruce Lehman

*Attest:*

BRUCE LEHMAN

*Attesting Officer*

*Commissioner of Patents and Trademarks*